US006168550B1

(12) United States Patent
Traore

(10) Patent No.: US 6,168,550 B1
(45) Date of Patent: Jan. 2, 2001

(54) MASSAGING DEVICE SYSTEM

(76) Inventor: Moussa Traore, P.O. Box 593, Pawtucket, RI (US) 02862

( * ) Notice: Under 35 U.S.C. 154(b), the term of this patent shall be extended for 0 days.

(21) Appl. No.: 09/258,324

(22) Filed: Feb. 25, 1999

(51) Int. Cl.[7] ..... A63B 23/16
(52) U.S. Cl. ..... 482/47; 601/137
(58) Field of Search ..... 482/47; 601/137, 601/113; 84/465

(56) References Cited

U.S. PATENT DOCUMENTS 802,026 * 4/1905 Beall .
3,738,651 * 6/1973 Norman et al. .

* cited by examiner

*Primary Examiner*—Michael A. Brown
*Assistant Examiner*—Lalita M. Hamilton

(57) ABSTRACT

A massaging device system for massaging the hands and upper torso of a user. The massaging device system includes an elongate rod having a pair of opposite ends, and a plurality of finger grooves therein.

6 Claims, 2 Drawing Sheets

MASSAGING DEVICE SYSTEM

BACKGROUND OF THE INVENTION

1. Field of the Invention

The present invention relates to massaging devices and more particularly pertains to a new massaging device system for massaging the hands and upper torso of a user.

2. Description of the Prior Art

The use of massaging devices is known in the prior art. More specifically, massaging devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,234,684 by Bridges; U.S. Pat. No. 5,399,136 by Bart; U.S. Pat. No. Des. 320,827 by Centafanti; U.S. Pat. No. 4,105,200 by Unger; U.S. Pat. No. 4,040,619 by Landi; and U.S. Pat. No. 1,440,053 by Brett.

While these devices fulfill their respective, particular objectives and requirements, the aforementioned patents do not disclose a new massaging device system. The inventive device includes an elongate rod having a pair of opposite ends, and a plurality of finger grooves therein.

In these respects, the massaging device system according to the present invention substantially departs from the conventional concepts and designs of the prior art, and in so doing provides an apparatus primarily developed for the purpose of massaging the hands and upper torso of a user.

SUMMARY OF THE INVENTION

In view of the foregoing disadvantages inherent in the known types of massaging devices now present in the prior art, the present invention provides a new massaging device system construction wherein the same can be utilized for massaging the hands and upper torso of a user.

The general purpose of the present invention, which will be described subsequently in greater detail, is to provide a new massaging device system apparatus and method which has many of the advantages of the massaging devices mentioned heretofore and many novel features that result in a new massaging device system which is not anticipated, rendered obvious, suggested, or even implied by any of the prior art massaging devices, either alone or in any combination thereof.

To attain this, the present invention generally comprises an elongate rod having a pair of opposite ends, and a plurality of finger grooves therein.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new massaging device system apparatus and method which has many of the advantages of the massaging devices mentioned heretofore and many novel features that result in a new massaging device system which is not anticipated, rendered obvious, suggested, or even implied by any of the prior art massaging devices, either alone or in any combination thereof.

It is another object of the present invention to provide a new massaging device system which may be easily and efficiently manufactured and marketed.

It is a further object of the present invention to provide a new massaging device system which is of a durable and reliable construction.

An even further object of the present invention is to provide a new massaging device system which is susceptible of a low cost of manufacture with regard to both materials and labor, and which accordingly is then susceptible of low prices of sale to the consuming public, thereby making such massaging device system economically available to the buying public.

Still yet another object of the present invention is to provide a new massaging device system which provides in the apparatuses and methods of the prior art some of the advantages thereof, while simultaneously overcoming some of the disadvantages normally associated therewith.

Still another object of the present invention is to provide a new massaging device system for massaging the hands and upper torso of a user.

Yet another object of the present invention is to provide a new massaging device system which includes an elongate rod having a pair of opposite ends, and a plurality of finger grooves therein.

Still yet another object of the present invention is to provide a new massaging device system that helps relieve muscle stress and cramps in a user's hands, arms, and shoulder regions.

Even still another object of the present invention is to provide a new massaging device system that is portable so that it may be easily carried to various locations, which is especially handy when travelling away from home.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

With reference now to the drawings, and in particular to FIGS. 1 through 5 thereof, a new massaging device system embodying the principles and concepts of the present invention will be described.

As best illustrated in FIGS. 1 through 5, the massaging device system generally comprises an elongate rod having a pair of opposite ends, and a plurality of finger grooves therein.

Figure 4:
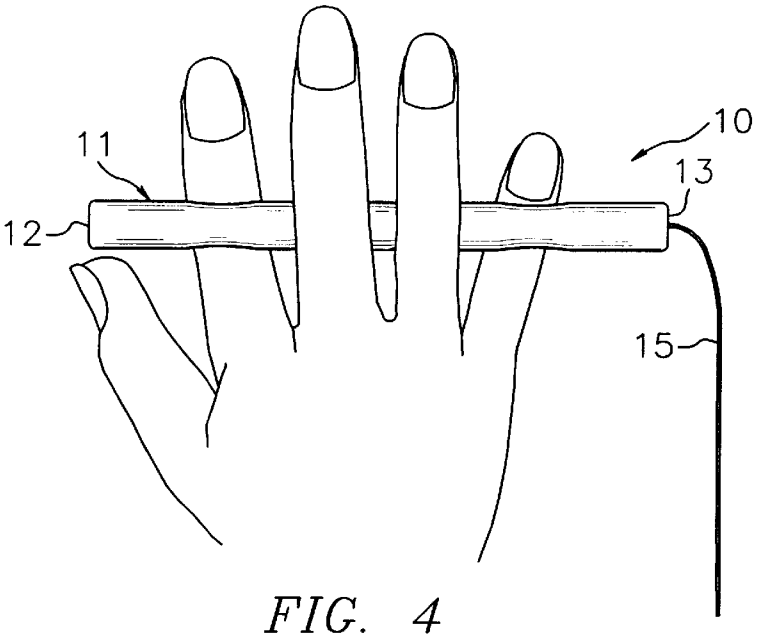
FIG. 4 is a schematic side view of the present invention illustrating a use of the hand massaging device.
Figure 5:
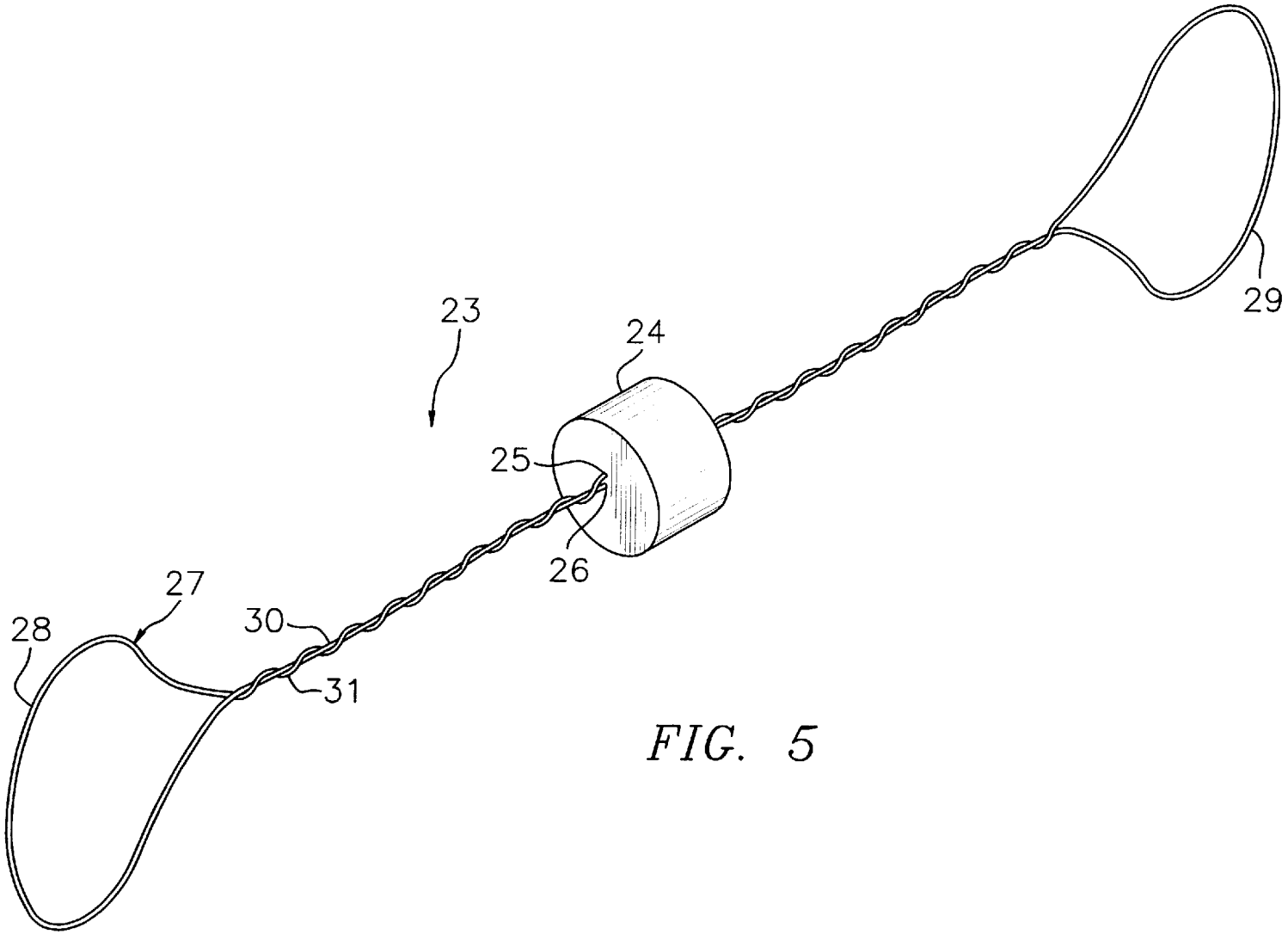
FIG. 5 is a schematic perspective view of the arm and shoulder massaging device.

In use, the massaging device system is designed for massaging the hands, arms, and shoulder regions of a user. In closer detail the massaging device system comprises a hand massaging device as illustrated in FIGS. 1 through 4 and an arm and shoulder massaging device as illustrated in FIG. 5.

Figure 3:
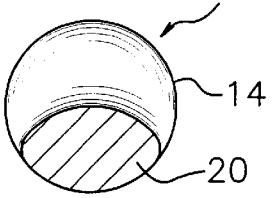
FIG. 3 is a schematic cross sectional view of the hand massaging device taken from line 3—3 of FIG. 1.

The hand massaging device 10 is designed for massaging the hands of a user and comprises an elongate rod 11 having a pair of opposite ends 12,13, and a longitudinal axis extending between the ends of the rod. As best illustrated in FIG. 3, the rod has a generally circular transverse cross section 14 taken in a plane substantially perpendicular to the longitudinal axis of the rod. The rod has a length defined between the ends of the rod and an outer diameter defined substantially perpendicular to the longitudinal axis of the rod. Preferably, the length of the rod is greater than about ten times the diameter of the rod for providing optimal massaging to a hand of a user. Even more preferably, the length of the rod is about twelve times greater than the diameter of the diameter of the rod. In an ideal illustrative embodiment, the length of the rod is about 6 inches and the diameter of the rod is about ½ inch.

A flexible loop 15 of a flexible elongate member, such as string or rope, is coupled to one of the ends of the rod. In use, the flexible loop is designed for hanging the hand massaging device on a hook or for extending a wrist of a user therethrough to secure the hand massaging device around the wrist of the user.

Figure 1:
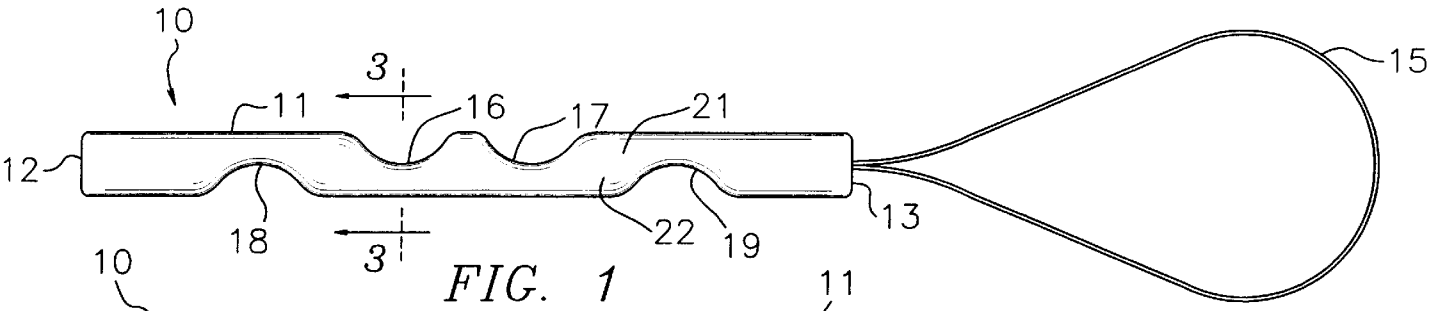
FIG. 1 is a schematic side view of a hand massaging device.
Figure 2:
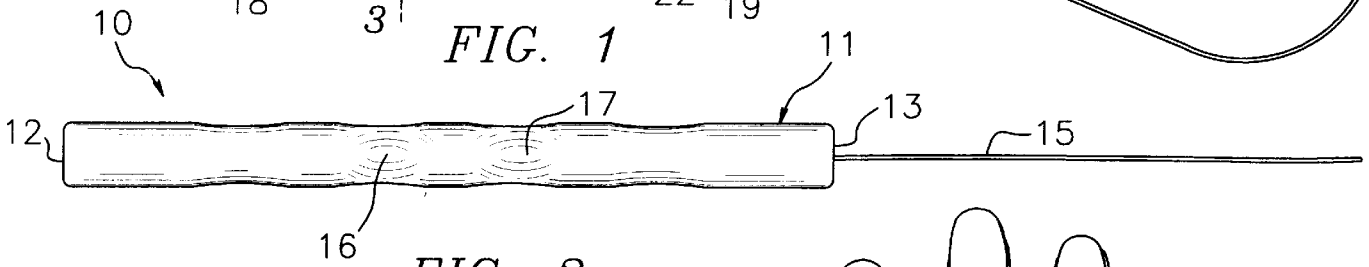
FIG. 2 is another schematic side view of the hand massaging device taken from a vantage perpendicular to FIG. 1.

The rod has a plurality of finger grooves 16,17,18,19 therein. Each of the finger grooves of the rod is designed for receiving therein a portion of an associated finger of a hand of a user is extended generally perpendicular to the longitudinal axis of the rod. As best illustrated in FIG. 1, Each of the finger grooves has a generally concave arcuate transverse cross section taken in a plane in which the longitudinal axis of the rod lies. As illustrated in FIG. 3, the rod has a generally oval transverse cross section 20 taken in plane substantially perpendicular to the longitudinal axis of the rod at each of the finger grooves.

The plurality of finger grooves comprises an inner pair of finger grooves 16,17 and an outer pair of finger grooves 18,19. As best illustrated in FIG. 1, the rod has a plane bisecting the rod into a pair of generally semi-cylindrical regions 21,22 with the longitudinal axis of the rod lying in the plane dividing bisecting the rod into the pair of regions. The inner pair of finger grooves is located in one of the regions of the rod, the outer pair of finger grooves is located in the other of the regions of the rod.

The inner pair of finger grooves are positioned along the longitudinal axis of the rod between the outer pair of finger grooves such that one of the finger grooves of the outer pair of finger grooves is positioned closest towards one of the ends of the rod and the other of the finger grooves of the outer pair of finger grooves is positioned closest towards the other of the ends of the rod. As illustrated in FIG. 4, in use, the outer pair of finger grooves are designed for receiving the index finger and pinkie finger of the hand of the user. The inner pair of finger grooves are designed for receiving the middle two fingers of the user's hand. This way the hand of the user is stretched to relieve muscle stress and cramps in the hand of the user.

With reference to FIG. 5, the arm and shoulder massaging device 23 is designed for massaging the arms and shoulder regions of a user and comprises a spinning disk 24 having a pair of generally circular opposite faces, and a pair of off-centered holes 25,26 extending through the spinning disk between the faces of the spinning disk. Preferably, the spinning disk comprises a plastic material for helping minimize the weight of the spinning disk while helping increase the durability of the spinning disk.

An endless loop 27 of a flexible elongate member is formed to have a spaced apart pair of end loop regions 28,29 and a pair of strand regions 30,31 connecting the end loop regions together. Ideally, the endless loop has a outer length defined between end loop regions of about 2 feet. One of the strand regions is extended through one of the holes of the spinning disk. The other of the strand regions is extended through the other of the holes of the spinning disk. In use, one of the end loop regions is designed for grasping with one hand of a user and the other of the end loop regions is designed for grasping with the other hand of the user. The strand regions are twisted together in a first direction whereby pulling apart of the end loop regions with the hands of a user untwists the strand regions and thereby causes the spinning disk to spin about an axis generally parallel to the strand regions which leads to the strand regions is twisted together in a second direction opposite the first direction. In use, the pulling action helps to relieve muscle stress and stiffness in the arms and shoulder regions of the user.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A massaging device system, comprising:

an elongate rod having a pair of opposite ends, and a longitudinal axis extending between said ends of said rod;

said rod having a plurality of finger grooves therein;

each of said finger grooves of said rod being adapted for receiving therein a portion of an associated finger of a hand of a user being extended generally perpendicular to said longitudinal axis of said rod;

wherein said plurality of finger grooves comprises an inner pair of finger grooves and an outer pair of finger grooves for accommodating each adjacent finger of a user's hand, said inner pair of finger grooves being positioned along said longitudinal axis of said rod between said outer pair of finger grooves such that one of said finger grooves of said outer pair of finger grooves is positioned closest towards one of said ends of said rod and the other of said finger grooves of said outer pair of finger grooves is positioned closest towards the other of said ends of said rod; and wherein each finger groove of said inner pair of said finger grooves is located in a substantially diametrically opposite location of said rod from each finger groove of said outer pair of said finger grooves to position fingers on opposite sides of said rod.

2. The massaging device system of claim 1, wherein said rod has a generally circular transverse cross section taken in a plane substantially perpendicular to said longitudinal axis of said rod, wherein each of said finger grooves has a generally concave arcuate transverse cross section taken in a plane in which said longitudinal axis of said rod lies, and wherein said rod has a generally oval transverse cross section taken in plane substantially perpendicular to said longitudinal axis of said rod at each of said finger grooves.

3. The massaging device system of claim 2, wherein said rod has a length defined between said ends of said rod and an outer diameter defined substantially perpendicular to said longitudinal axis of said rod, wherein said length of said rod is greater than about ten times said diameter of said rod.

4. The massaging device system of claim 2, wherein said rod has a length defined between said ends of said rod and an outer diameter defined substantially perpendicular to said longitudinal axis of said rod, and wherein said length of said rod is about twelve times greater than said diameter of said rod.

5. The massaging device system of claim 1, wherein said rod has a plane dividing said rod into a pair of regions, said longitudinal axis of said rod lying in said plane dividing said rod into said pair of regions, wherein said inner pair of finger grooves are located in one of said regions of said rod, and wherein said outer pair of finger grooves are located in the other of said regions of said rod.

6. A massaging device system, comprising:

an elongate rod having a pair of opposite ends, and a longitudinal axis extending between said ends of said rod;

said rod having a generally circular transverse cross section taken in a plane substantially perpendicular to said longitudinal axis of said rod;

said rod having a length defined between said ends of said rod and an outer diameter defined substantially perpendicular to said longitudinal axis of said rod;

wherein said length of said rod is about twelve times greater than said diameter of said diameter of said rod;

wherein said length of said rod is about 6 inches and said diameter of said rod is about ½ inch;

a flexible loop of a flexible elongate member being coupled to one of said ends of said rod, said flexible loop being adapted for hanging said hand massaging device around the wrist of a user;

said rod having a plurality of finger grooves therein;

each of said finger grooves of said rod being adapted for receiving therein a portion of an associated finger of a hand of a user being extended generally perpendicular to said longitudinal axis of said rod;

each of said finger grooves having a generally concave arcuate transverse cross section taken in a plane in which said longitudinal axis of said rod lies;

said rod having a generally oval transverse cross section taken in plane substantially perpendicular to said longitudinal axis of said rod at each of said finger grooves for accommodating each adjacent finder of a user's hand;

said plurality of finger grooves comprising an inner pair of finger grooves and an outer pair of finger grooves;

said rod having a plane dividing said rod into a pair of generally semi-cylindrical regions, said longitudinal axis of said rod lying in said plane dividing said rod into said pair of regions;

said inner pair of finger grooves being located in one of said regions of said rod, said outer pair of finger grooves being located in the other of said regions of said rod;

said inner pair of finger grooves being positioned along said longitudinal axis of said rod between said outer pair of finger grooves such that one of said finger grooves of said outer pair of finger grooves is positioned closest towards one of said ends of said rod and the other of said finger grooves of said outer pair of finger grooves is positioned closest towards the other of said ends of said rod; and said outer pair of finger grooves being adapted for receiving the index finger and the pinkie finger of the hand of the user, said inner pair of finger grooves being adapted for receiving the middle two fingers of the user's hand.

* * * * *